US005358060A

United States Patent [19]

Ebara

[11] Patent Number: 5,358,060

[45] Date of Patent: Oct. 25, 1994

[54] SUCCESSIVE HOLE BORING MACHINE AND LOST STRIKE PREVENTING DEVICE FOR SUCCESSIVE HOLE BORING MACHINE

[75] Inventor: Yoshio Ebara, Fujioka, Japan

[73] Assignees: Furukawa Co., Ltd.; Okumura Corporation, Japan

[21] Appl. No.: 78,757

[22] Filed: Jun. 16, 1993

[30] Foreign Application Priority Data

Jun. 16, 1992 [JP] Japan ..... 4-041311[U]
Jun. 16, 1992 [JP] Japan ..... 4-156914

[51] Int. Cl.[5] ..... E21B 4/06
[52] U.S. Cl. ..... 175/108; 175/296
[58] Field of Search ..... 175/108, 135, 162, 293, 175/296

[56] References Cited

U.S. PATENT DOCUMENTS

| | | | |
|---|---|---|---|
| 3,193,025 | 7/1965 | Reitzel | 173/73 |
| 3,760,887 | 9/1973 | Palauro | 173/134 |
| 3,760,915 | 9/1973 | Young et al. | 175/108 X |
| 3,912,025 | 10/1975 | Deeter et al. | 175/108 X |
| 4,681,170 | 7/1987 | Ohi | 173/50 |
| 4,883,133 | 11/1989 | Fletcher et al. | 175/93 |
| 5,139,096 | 8/1992 | Lister | 175/296 X |

FOREIGN PATENT DOCUMENTS

| | | |
|---|---|---|
| 51-39601 | 3/1976 | Japan . |
| 54-72781 | 5/1979 | Japan . |
| 54-126601 | 10/1979 | Japan . |
| 55-17791 | 2/1980 | Japan . |
| 57-116893 | 7/1982 | Japan . |
| 59-18492 | 4/1984 | Japan . |

OTHER PUBLICATIONS

European Search Report Dated 08 Sep. 1993.

*Primary Examiner*—Thuy M. Bui
*Attorney, Agent, or Firm*—Basile and Hanlon

[57] ABSTRACT

A plurality of rods each having a bit at a front end are disposed in parallel to one another so that adjacent bits are displaced to some extent forward and backward, and a striking device operatively connected to each of the rods includes a striking block. The striking block includes a single cylinder block having a plurality of cylinder tubes, and a striking piston is slidably fitted into each of the cylinder tubes. The striking block further includes a change-over valve for changing over between a forward movement and a backward movement of each striking piston. A rear end of each rod is connected through an adapter to a shank rod which is connected to the striking device. In the striking device, a spring is provided between a bearing holder which holds the shank rod rotatably and the adapter to push the rod in a forward direction. When the bit is not reached the rock, the rod is pushed forward by the spring to hold the shank rod at a position before the striking point.

2 Claims, 9 Drawing Sheets

SUCCESSIVE HOLE BORING MACHINE AND LOST STRIKE PREVENTING DEVICE FOR SUCCESSIVE HOLE BORING MACHINE

BACKGROUND OF THE INVENTION

1. Field of the Invention

The present invention relates to a successive hole boring machine for boring successive holes (a slit-like hole formed by a plurality of successive holes) into a rock, and to a device for preventing a lost strike of the successive hole boring machine.

2. Prior Art

As machines for boring successive holes for the purposes of constructing an underground continuous wall, and digging an underground space such as an underground tank, an underground tunnel, and the like, there are known in the art to use a multiaxis auger (Japanese Patent Publication No. 59-18492), a multiplicity of rock drills installed on a slide frame in parallel to one another (Japanese Patent Laid-Open Publication No. 54-126601), rock drills displaced from each other respectively forward and backward to reduce a rod interval with respect to a width of the rock drill (Japanese Patent Laid-Open Publication No. 57-116893).

However, in the machine which uses the multiaxis auger, it is difficult to drill a hard rock layer. In the case where the multiplicity of rock drills are installed on a slide frame in parallel to one another, the mounting of the rock drills on the slide frame is troublesome, and furthermore, since the rod interval is larger than the width of the rock drill, bits of large diameter are needed to bore the successive holes and the loss of energy is large. The rod interval will be reduced to some extent when the rock drills are displaced from one another forward and backward, however, since the length of the slide frame between the front side and the rear side is increased, a large and long guide shell will be necessary. Furthermore, hoses for respectively supplying pressurized air or pressurized oil to the multiplicity of rock drills must be connected thereto. Thus, not only the piping work is troublesome but also the hoses disturb the boring work and the hoses are apt to be damaged.

On the other hand, in the prior art, where a breaker is used, at the time when the object to be broken is broken, a chisel slips out and a lost strike, or ineffective strike occurs resulting in the damage of a breaker main body. As a countermeasure, a lost strike preventing device (Japanese Utility Model Laid-Open Publication Nos. 51-39601 and 54-72781) is known in which based on the determination of the cause as being the thrust of the breaker applied to the object to be broken, a fluid passage for striking the breaker is automatically opened and closed. In another lost strike preventing device (Japanese Utility Model Laid-Open Publication No. 55-17791), when a striking piston advances beyond a normal striking point, a feed port of working fluid is interrupted to stop the driving of the piston.

In contrast, in the case of a rock drill, since a bit positioned at a front end of a rod always reaches the rock by applying thrust by a feed mechanism at the time of boring holes, there is no fear of lost striking and a lost strike preventing device is not particularly required.

However, in a successive hole boring machine in which a plurality of rods having bits attached to front ends thereof are disposed in parallel so that adjacent bits are somewhat displaced from one another forward and backward (or longitudinally, or axially), and each rod is connected to a shank rod which is inserted into a striking device, in performing a spot facing work or the like, the bits located at backward positions do not reach the rock in some cases. As a result, when the striking operation is performed in this condition, a lost strike will take place, and loosening of screws at connection portions of the rods, breakage of rods, damage of the striking device or bits will be caused.

Accordingly, the lost strike preventing device is required. However, in the successive hole boring machine, the striking device having a plurality of shank rods inserted therein is fixed to the single slide frame, and the thrust is applied by the feed mechanism. Thus, it is difficult to detect the thrust for each of the rods, and it is impossible to adopt the lost strike preventing device of the type in which by detecting the cause in the thrust and to automatically open and close the striking fluid passage. Furthermore, in the successive hole boring machine, in order to reduce the consumption of energy at the time of performing the boring work for successive holes, it is necessary to narrow the interval between the rods and to reduce the bit diameter. However, in the lost strike preventing device designed to stop the driving of the piston by interrupting the feed port of the working fluid when the striking piston advances beyond the normal striking point, there is a problem in which the structure of the striking device is complicated and large in size, and the interval between the rods cannot be narrowed.

SUMMARY OF THE INVENTION

The present invention solves the problems mentioned above in the prior art successive hole boring machine. It is an object of the present invention to provide a successive hole boring machine which enables to narrow a rod interval, to reduce a diameter of bits used, to reduce the consumption of energy in the boring work of successive holes, and to make easy the boring work by reducing the number of hoses to be connected.

It is another object of the present invention to provide a lost strike preventing device used with the successive hole boring machine which enables to prevent loosening of screws at connecting portions of rods due to a lost strike, and to prevent breakage of rods and damage of a striking device and bits.

In the present invention, in order to solve the above-mentioned problems, in a successive hole boring machine, a plurality of rods each having a bit attached to a front end thereof are disposed in parallel one another so that adjacent bits are displaced to some extent forward and backward, and each of the rods is connected to a striking device. The striking device is constituted by a striking block including a single cylinder block having a plurality of cylinder tubes, a striking piston slidably fitted into each of the cylinder tubes, and a change-over valve for changing over between a forward movement and a backward movement of the striking piston in each cylinder tube. A desired number of striking blocks may be provided in parallel.

Since the striking device is constituted by a striking block including a single cylinder block having a plurality of cylinder tubes, it is possible to place the cylinder tubes close to one another, and as compared with the case wherein a multiplicity of rock drills are installed on a slide frame in parallel to one another, the interval of the rods can be reduced to a great extent without increasing the length of the slide frame in a front-rear (longitudinal or axial) direction by displacing the rock drills forward and backward. Accordingly, since the the diameter of the bits for forming the successive holes can be reduced, the energy consumption during a boring work for successive holes is reduced. Furthermore, since it is possible to provide a common passage for supplying and discharging work fluid to and from the plurality of cylinder tubes, the number of hoses connected to the striking device is decreased. As a result, the piping work is easy, and it is possible to eliminate possible disturbance in the boring work by the hoses and a fear of damage of the hoses. Thus, the boring work is easy.

Furthermore, in the present invention, in a successive hole boring machine in which a plurality of rods each having a bit attached to a front end thereof are disposed in parallel to one another so that adjacent bits are respectively displaced to some extent forward and backward, and a rear end of each rod is connected through an adapter to a shank rod which is attached to a striking device, and a bearing holder fixed to the striking device for rotatably holding the shank rod with respect to the striking device is provided, there is provided with a spring between the bearing holder and the adapter for pressing the rod in a forward direction.

In the boring work, since the striking device is applied with thrust in a forward direction, when the bit at the front end is reaching the rock, the spring is elastically compressed, and the the rear end of the shank rod is positioned at a striking point, and the shank rod is struck due to a forward movement of the striking piston.

When the bit has not yet reached the rock, the rod is pushed forward by the spring, and the shank rod is held at a forward position with respect to the striking point. Thus, even when the striking piston advances, the shank rod is not struck, and since the striking piston begins movement in a backward direction, a lost strike can be prevented.

Specifically, in the lost strike preventing device for the successive hole boring machine in the present invention, since it is possible to reduce the rod interval and to reduce the diameter of the bits used, it is possible to prevent loosening of screws at connecting portions of the rods, and to prevent damage of the rods, and damage of the striking device and the bits due to the lost strike.

DESCRIPTION OF THE PREFERRED EMBODIMENT

Figure 1:
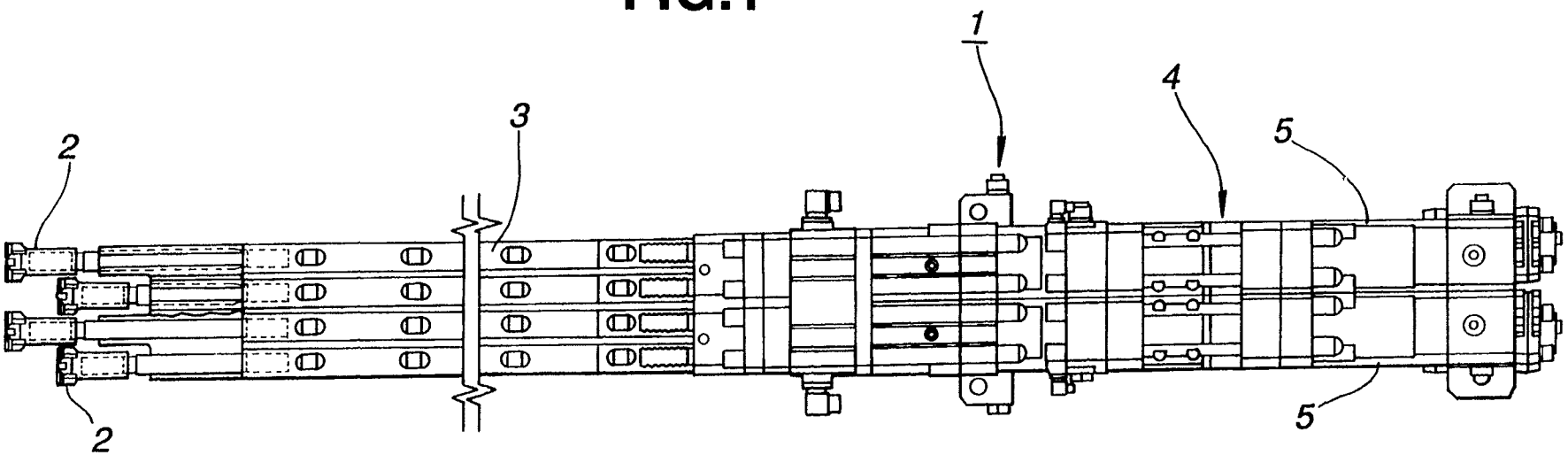
FIG. 1 is a plan view of a successive hole boring machine in the present invention.
Figure 2:
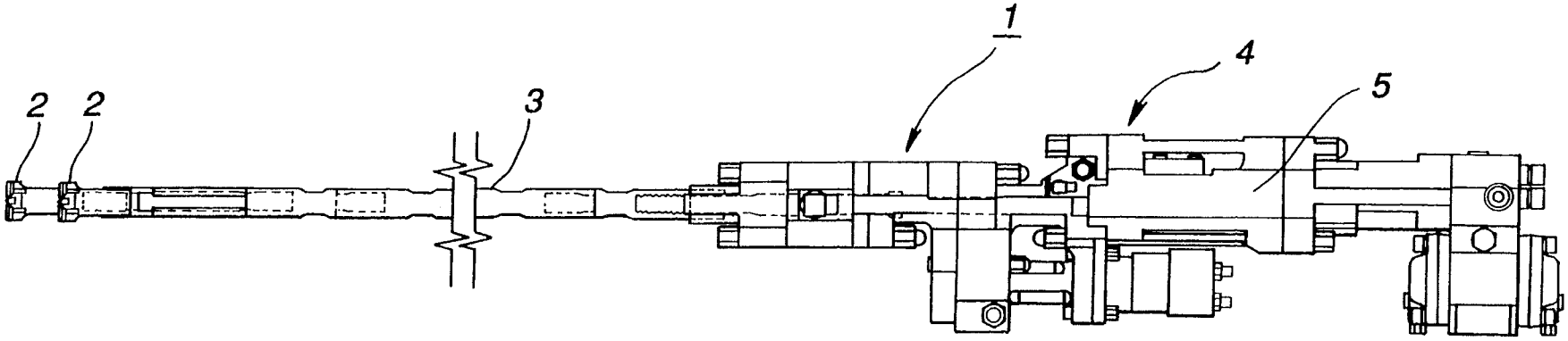
FIG. 2 is a side view of the successive hole boring machine of FIG. 1.
Figure 3:
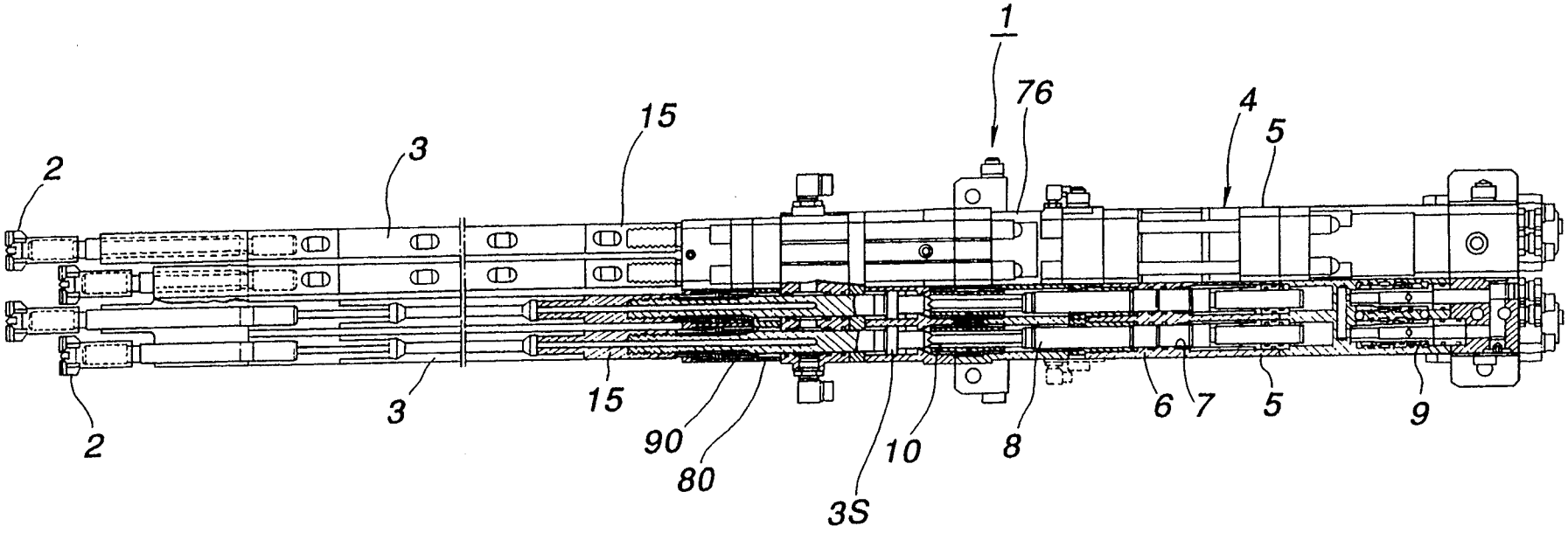
FIG. 3 is a partial, horizontal sectional view of the successive hole boring machine of FIG. 1.

An embodiment of the present invention will be described with reference to the drawings.

In a successive hole boring machine 1 in this embodiment, four rods 3 each having a bit 2 attached to a front end thereof are disposed in parallel to one another so that adjacent two bits 2 are somewhat displaced respectively forward and backward (longitudinally or axially). A rear end of each rod 3 is screwed to a shank rod 3S through an adapter 15, the shank rod 3S being inserted and attached to a striking device 4. The striking device 4 is constituted by two striking blocks 5 which are disposed in parallel to each other. Each striking block 5 includes a single cylinder block 6 which has at its front end a front head 76, and two cylinder tubes 7 are bored in the single cylinder block 6. Each cylinder tube 7 has a striking piston 8 which is slidably fitted into the cylinder tube 7, and a change-over valve device 9 for change over between a forward movement and a backward movement of each piston 8 is disposed at a rear position of the cylinder tubes 7.

A chuck driver 10 is mounted at a front position of each cylinder tube 7 for rotating each shank rod 3S which is attached to the chuck driver 10. Two chuck drivers 10 within each of the two striking blocks 5 are driven by a single orbit motor 13 through a drive gear 11 and an idle gear 12. By rotating the orbit motors 13 of the right-hand and left-hand striking blocks 5 in opposite directions to each other, the bits 2 associated with the right-hand and left-hand striking blocks 5 can be rotated in opposite directions to each other so as to cancel out rotational reaction power during boring of a rock.

Figure 7:
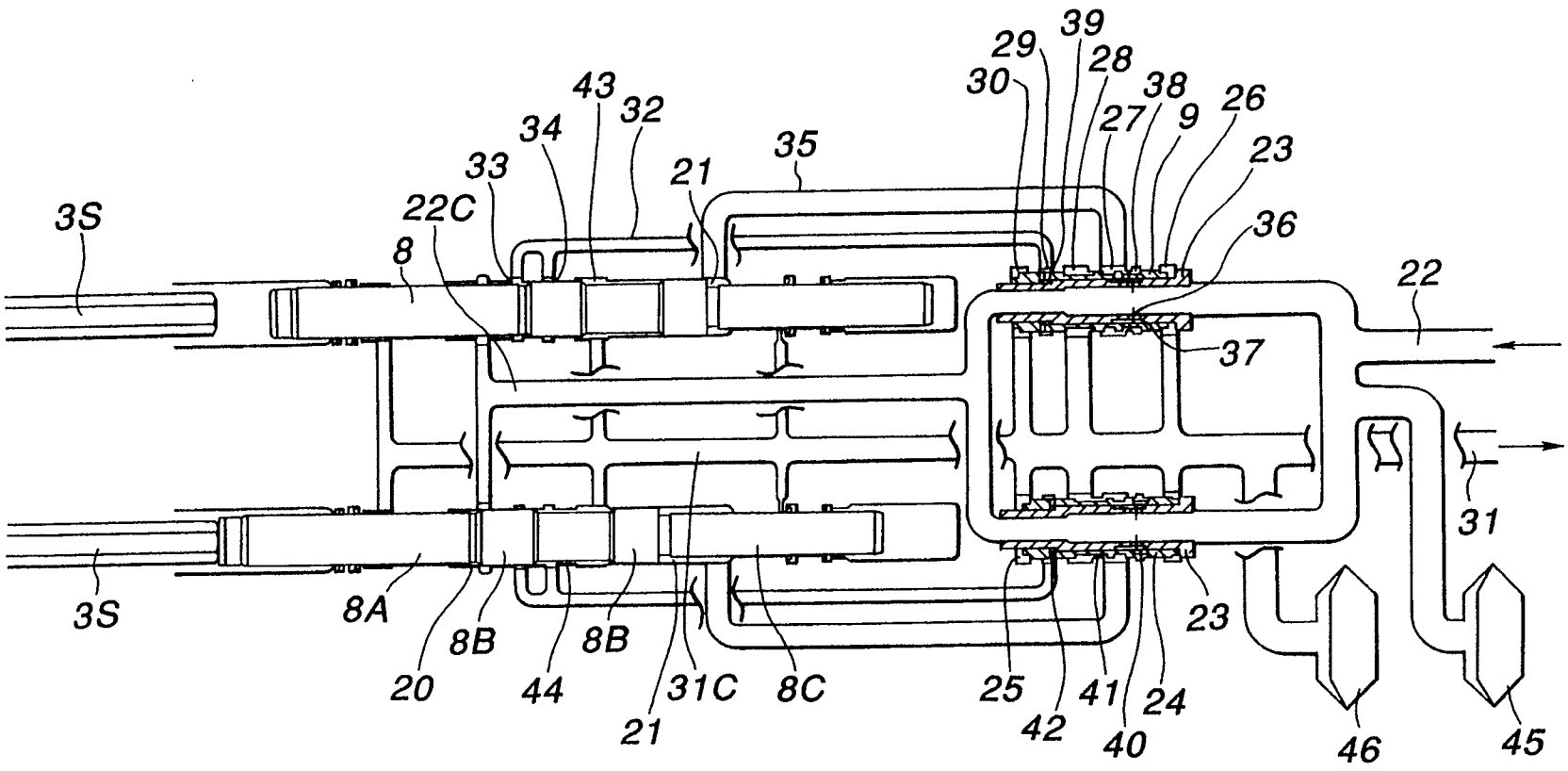
FIG. 7 shows a hydraulic circuit diagram of a striking block.

With reference to FIG. 7, each striking piston 8 has a large diameter portion 8B, a small diameter portion 8A at a front side, and a small diameter portion 8C at a rear side, and owing to these differences in diameter, a front oil chamber 20 and a rear oil chamber 21 are formed. The diameter of the small diameter portion 8C at the rear side is further smaller than that of the small diameter portion 8A at the front side, and thus, a pressure receiving area of the striking piston 8 at the side of the rear oil chamber 21 is larger than the pressure receiving area at the side of the front oil chamber 20. The front oil chambers 20 at both sides within each striking block 5 are supplied with pressurized oil through a common high pressure oil path 22C of a high pressure circuit 22. A valve plug 23 fitted into the change-over valve device 9 has a center portion in communication with the high pressure circuit 22, and has a valve chamber 25 formed between an outer peripheral surface of the valve plug 23 and the cylinder block 6, and a cylindrical change-over valve 24 is slidably fitted into the valve chamber 25.

In the valve chamber 25, a low pressure port 26 is provided at a rear end, and a feed and discharge port 27, a low pressure port 28, a valve control port 29 and a low pressure port 30 are provided in this order from the rear to the front side. The feed and discharge port 27 is connected to the rear oil chamber 21 through a feed and discharge path 35, and the low pressure ports 26, 28 and 30 are connected to the common low pressure oil path 31C of the low pressure circuit 31, and the valve control port 29 is connected through a valve control path 32 to a control port 33 and a second control port 34 which are provided at a front portion of the cylinder tube 7. In the inside of the valve chamber 25, there is provided with an oil feed chamber 37 which is always in communication with the high pressure circuit 22 through a oil feed hole 36 bored in the valve plug 23. A stepped portion is formed on an outer peripheral surface of the change-over valve 24 so that a rear portion has a larger diameter, and a valve restricting oil chamber 38 is formed in the stepped portion. Furthermore, a stepped portion is formed on an inner peripheral surface of the change-over valve 24 so that a front portion has a smaller diameter, and a valve restricting oil chamber 39 is formed in the stepped portion. A pressure receiving area at the side of the valve restricting oil chamber 39 is larger than a pressure receiving area at the side of the valve restricting oil chamber 38. The change-over valve 24 has a oil feed hole 40 for bringing the feed and discharge port 27 in communication with the oil feed chamber 37 at the forward movement position, and has a oil discharge groove 41 for bringing the low pressure port 28 in communication with the feed and discharge port 27 at the backward movement position. Furthermore, a valve control hole 42 is bored for bringing the valve control port 29 in communication with a valve control oil chamber 39. The valve restricting oil chamber 38 is always in communication with the high pressure circuit 22.

The cylinder tube 7, as described above, has the control port 33 and the second control port 34, and has at its rear side an oil discharge port 43 which is connected through the common low pressure oil path 31C of the low pressure circuit 31 to a tank. The striking piston 8 has on its large diameter portion 8B, a groove 44 for bringing the second control port 34 in communication with the oil discharge port 43 at the forward movement position of the striking piston 8. The high pressure circuit 22 and the low pressure circuit 31 are respectively provided with a high pressure accumulator 45 and a low pressure accumulator 46.

In the striking device 4, when the change-over valve 24 is at a forward position, the feed and discharge port 27 is in communication with the oil feed chamber 37 through the oil feed hole 40. Accordingly, both the rear oil chamber 21 and the front oil chamber 20 are in communication with the high pressure circuit 22. Since the pressure receiving area of the striking piston 8 at the side of the rear oil chamber 21 is larger than the pressure receiving area at the side of the front oil chamber 20, the striking piston 8 is moved forward. Under this condition, the control port 33 is open to the side of the front oil chamber 20, and the second control port 34 is closed by the large diameter portion 8B of the striking piston 8. As a result, the valve control oil chamber 39 which is in communication with the front oil chamber 20 through the valve control path 32 is at a high pressure. Thus, both the valve restricting oil chamber 38 and the valve control oil chamber 39 are at the high pressure. Since the pressure receiving area at the side of the valve control oil chamber 39 is larger than the pressure receiving area at the side of the valve restricting oil chamber 38, the change-over valve 24 is maintained at the forward position.

When the striking piston 8 is moved forward, the control port 33 is closed by the large diameter portion 8B of the striking piston 8, and the second control port 34 is brought into communication with the oil discharge port 43 through the groove 44. Thus, the valve control path 32 and the valve control oil chamber 39 are at a low pressure. At this time, since the valve restricting oil chamber 38 is maintained at the high pressure, the change-over valve 24 is moved backward. When the change-over valve 24 is moved backward, the oil feed hole 40 is closed, and the discharge and feed port 27 is brought into communication with the low pressure port 28 through the oil discharge groove 41. Thus, the rear oil chamber 21 is brought into communication with the low pressure circuit 31. The striking piston 8 which is moved forward strikes a rear end of the shank rod 3S and stops the forward movement, and since the rear oil chamber 21 is at the low pressure, the striking piston 8 starts a backward movement.

When the striking piston 8 is moved backward, the control port 33 is open to the side of the front oil chamber 20, and the second control port 34 is closed by the large diameter portion 8B of the striking piston 8. Thus, the valve control oil chamber 39 which is in communication with the front oil chamber 20 through the valve control path 32 becomes high pressure again, and the change-over valve 24 is moved forward. When the change-over valve 24 is moved forward, the rear oil chamber 21 is brought into communication with the high pressure circuit 22 and the pressure is raised. As a result, the striking piston 8 which continues its backward movement by inertia is braked and stops its movement, and again starts its forward movement cycle. Thereafter, similar cycles are repeated.

The striking device 4 is constituted by the two striking blocks 5 disposed in parallel to each other, and the single cylinder block 6 includes the two cylinder tubes 7 as described in the foregoing. Accordingly, it is possible to dispose the cylinder tubes 7 close to each other, and as compared with the case wherein the multiplicity of rock drills are installed on the slide frame in parallel to one another, the rod interval is reduced to a great extent without requiring to displace the rock drills respectively forward and backward and to extend the slide frame in the front-rear direction. As a result, the bits 2 for forming successive holes have a small diameter, and the energy consumption during the boring work for the successive holes is small. Furthermore, since the common high pressure oil path 22C and the common low pressure oil path 31C for feeding and discharging the working fluid to and from the two cylinder tubes 7 are formed in the cylinder block 6, the number of hoses connected to the striking device 4 can be reduced. Thus, the piping work is easy, and there is little fear of disturbance of the boring work by the hoses and of damage of the hoses.

Figure 8:
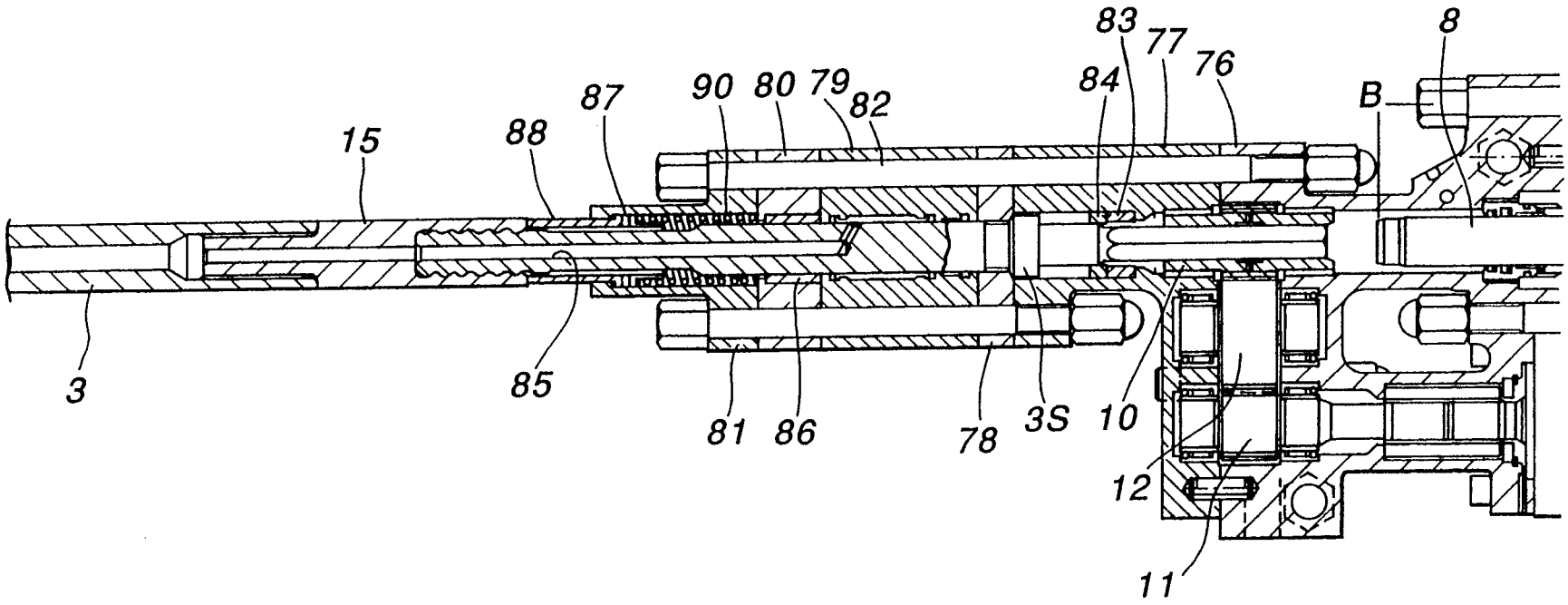
FIG. 8 is an enlarged sectional view of a portion near a shank rod in the successive hole boring machine of FIG. 1.
Figure 9:
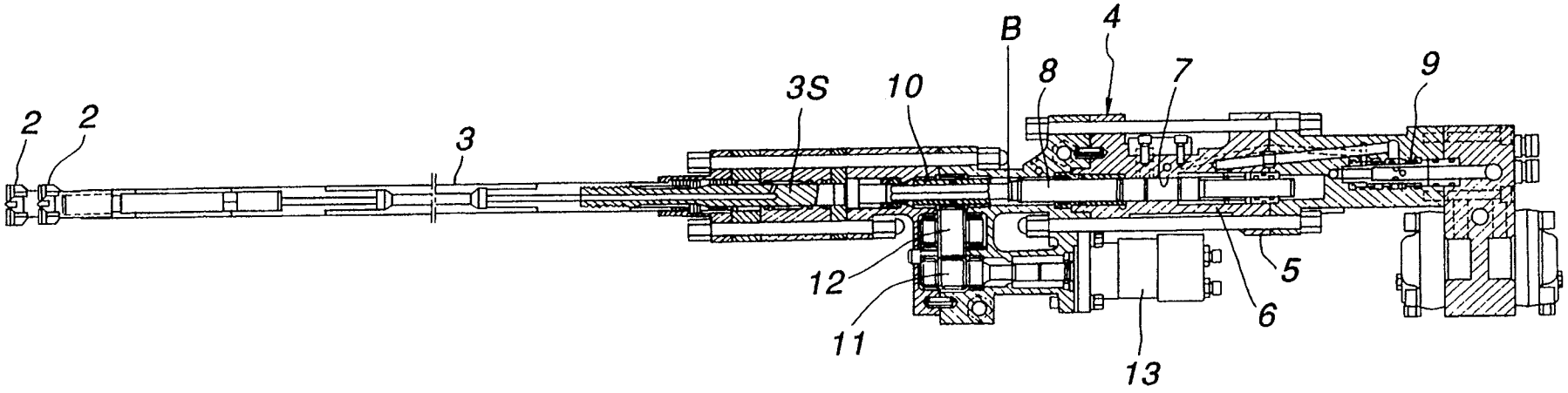
FIG. 9 is a longitudinal sectional view of the successive hole boring machine of FIG. 1 showing a condition in which a rod is pushed forward.

Furthermore, as shown in FIG. 8, in the striking device 4, at the front side of a front head 76, a front cover 77, a steel retainer 78, a swivel body 79, a bearing holder 80 and a front cap 81 are connected and fixed by a through bolt 82. A thrust bush 83 and a thrust ring 84 are mounted on an inner peripheral surface of the front cover 77, and the steel retainer 78 and the thrust ring 84 restrict a movable range of the shank rod 3S in forward and backward directions. The swivel body 79 supplies dust discharging fluid into a hollow hole 85. A front bush 86 is mounted on an inner peripheral surface of the bearing holder 80 to hold the inserted shank rod 3S rotatably.

A thrust ring 87 and a sleeve 88 are mounted at a front end portion of the front cap 81, and a spring 90 for pushing the adapter 15 of the rod 3 forward through the sleeve 88 is provided between the bearing holder 80 and the thrust ring 87. An outer diameter of the spring 9 is substantially equal to that of the rod 3 and the adapter 15, and the size of the striking device 4 is not made large. Thus, there is no need to widen the rod interval. In this respect, an inner periphery of a front end edge of the front cap 81 has small diameter, and an outer periphery of a rear end edge of the sleeve 88 has a large diameter to prevent slipping out in a forward direction.

Figure 4:
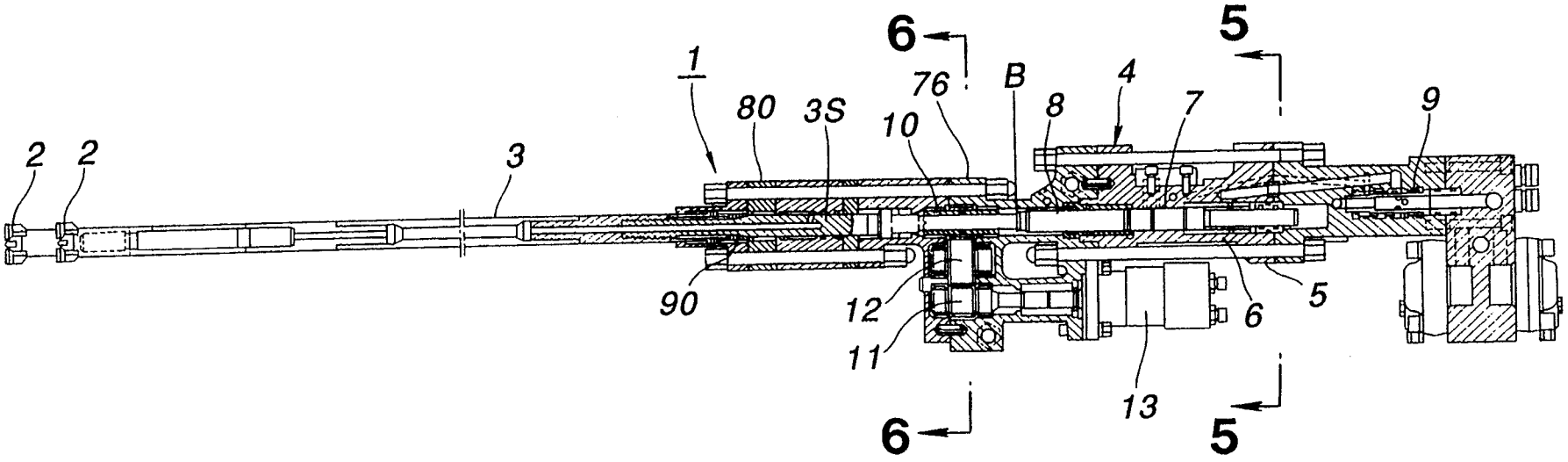
FIG. 4 is a longitudinal sectional view of the successive hole boring machine of FIG. 1.
Figure 5:
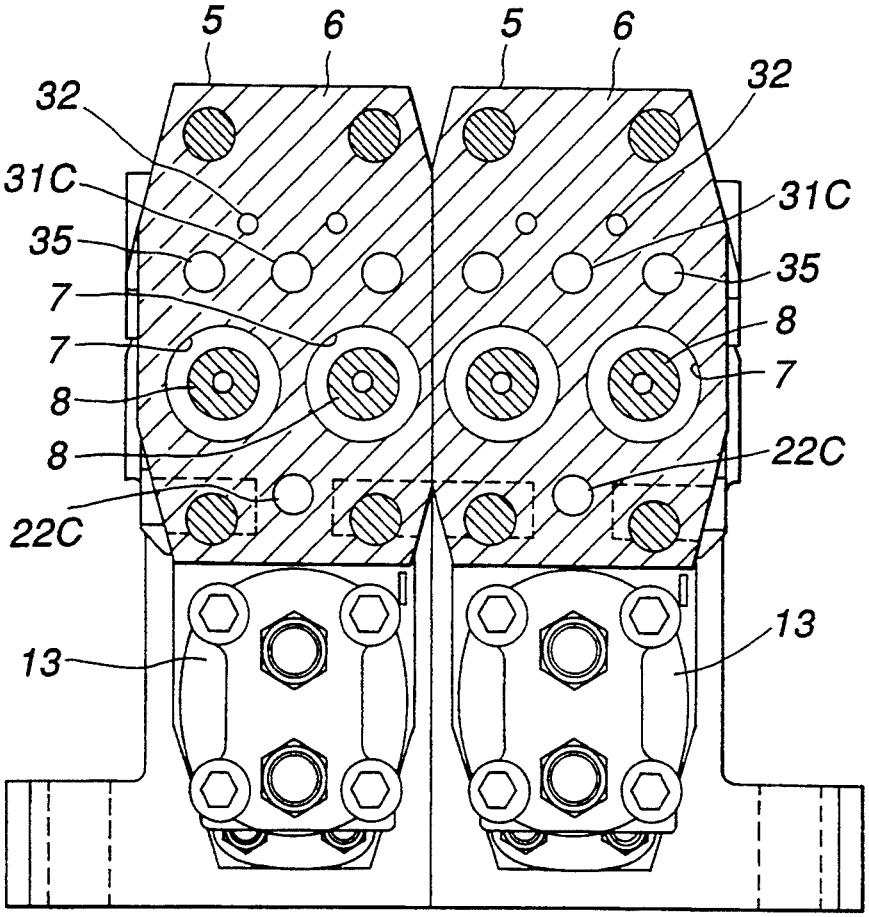
FIG. 5 is a sectional view taken along the line 5—5 in FIG. 4.
Figure 6:
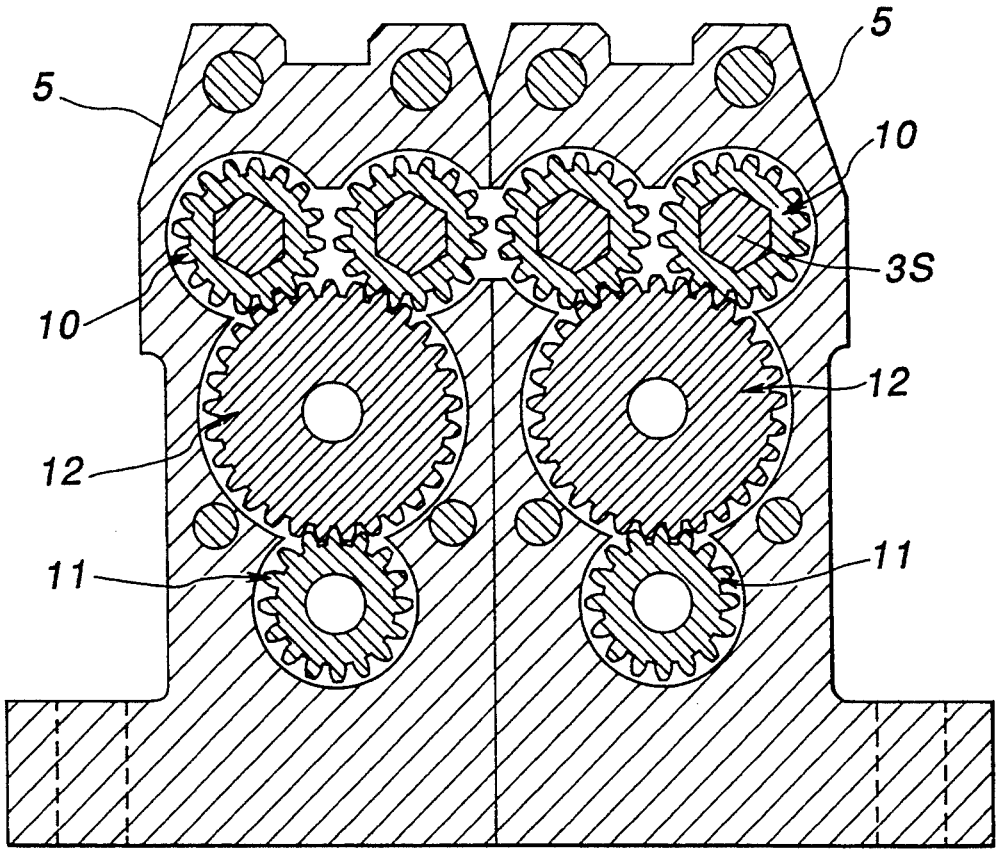
FIG. 6 is a sectional view taken along the line 6—6 in FIG. 4.

At the time of boring operation, since the forward thrust is applied to the striking device 4, if the bit 2 positioned at the front end has reached the rock, the spring 90 is resiliently compressed and a rear end of the shank rod 3S is positioned at a striking point B as shown in FIG. 4. Thus, the shank rod 3S is struck by a forward movement of the striking piston 8.

When the bit 2 has not reached the rock, the rod 3 is pushed forward by the spring 90, and the rear end of the shank rod 3S is held at a position before the striking point B. As a result, even when the striking piston 8 is moved forward, the shank rod 3S is not struck, and then since the striking piston 8 begins to move backward, the lost strike is prevented.

What is claimed is:

1. A successive hole boring machine comprising:

a plurality of rods respectively having bits attached to front ends thereof, the plurality of rods being disposed in parallel to one another so that adjacent bits are displaced forwardly and backwardly from each other respectively by a predetermined distance; and a striking device operatively connected to each of the plurality of rods, the striking device including a striking block, the striking block including:

a single cylinder block accommodating therein a plurality of cylinder tubes;

a plurality of striking pistons respectively slidably fitted into the cylinder tubes;

a pressurized fluid source for driving the striking pistons; and a change-over valve for changing over a fluid path from the pressurized fluid source to each of the striking pistons to change over between a forward movement and a backward movement of each striking piston.

2. The successive hole boring machine according to claim 1, wherein the striking device includes a plurality of striking blocks.

* * * * *